US011987427B2

(12) United States Patent
Arai

(10) Patent No.: US 11,987,427 B2
(45) Date of Patent: May 21, 2024

(54) PACKAGING BOX AND SHEET MATERIAL

(71) Applicant: Tomoaki Arai, Kanagawa (JP)

(72) Inventor: Tomoaki Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 149 days.

(21) Appl. No.: 17/689,111

(22) Filed: Mar. 8, 2022

(65) Prior Publication Data

US 2022/0297874 A1 Sep. 22, 2022

(30) Foreign Application Priority Data

Mar. 19, 2021 (JP) ..... 2021-045713

(51) Int. Cl.
*B65D 5/20* (2006.01)
*B65D 5/02* (2006.01)
*B65D 5/22* (2006.01)

(52) U.S. Cl.
CPC ..... *B65D 5/2057* (2013.01); *B65D 5/0254* (2013.01); *B65D 5/22* (2013.01)

(58) Field of Classification Search
CPC ..... B65D 5/6602; B65D 5/6626; B65D 5/2052–2057; B65D 5/0254; B65D 5/0236; B65D 5/22
USPC ... 229/122.32, 165–180, 149–150, 126, 141, 229/142, 151, 153, 121, 220–224, 185.1, 229/190, 195, 197
See application file for complete search history.

(56) References Cited

U.S. PATENT DOCUMENTS 1,196,365 A * 8/1916 Jennings ..... B65D 5/22 229/151
5,263,634 A * 11/1993 Korine ..... B65D 5/2019 229/906
5,351,880 A * 10/1994 Goudreau ..... B65D 85/36 229/120.32
5,971,261 A * 10/1999 Grunfeld ..... B65D 5/422 53/473
6,293,400 B1 9/2001 Arai et al.
6,345,758 B2 * 2/2002 Jaggi ..... B65D 5/722 229/173
6,386,440 B1 * 5/2002 Tulkoff ..... B65D 85/36 229/199
2008/0110965 A1 5/2008 Arai
(Continued)

FOREIGN PATENT DOCUMENTS

JP 5-095812 4/1993
JP 2008-094418 4/2008
JP 2016-094212 5/2016
(Continued)

*Primary Examiner* — Christopher R Demeree
*Assistant Examiner* — Phillip D Schmidt
(74) *Attorney, Agent, or Firm* — Harness, Dickey & Pierce, P.L.C.

(57) ABSTRACT

A packaging box includes a first pair of side plates facing each other, a second pair of side plates facing each other, an upper plate to close an upper opening of the packaging box, a bottom plate to close a lower opening of the packaging box, a folded inward contact flap, and a holding mechanism. The folded inward contact flap is connected to a lateral side of one of the first pair of side plates and folded at the lateral side to be in contact with one of the second pair of side plates. The holding mechanism holds contact between the folded inward contact flap and the one of the second pair of side plates.

9 Claims, 14 Drawing Sheets

(56) References Cited

U.S. PATENT DOCUMENTS

| | | | | |
|---|---|---|---|---|
| 2020/0339303 | A1* | 10/2020 | Zeiler | B65D 5/3642 |
| 2021/0371153 | A1* | 12/2021 | Borst, Sr. | B65D 5/42 |

FOREIGN PATENT DOCUMENTS

| | | | |
|---|---|---|---|
| JP | 2020-100425 | | 7/2020 |
| KR | 20-0394927 | Y1 * | 9/2004 |

* cited by examiner

PACKAGING BOX AND SHEET MATERIAL

CROSS-REFERENCE TO RELATED APPLICATION

This patent application is based on and claims priority pursuant to 35 U.S.C. § 119(a) to Japanese Patent Application 2021-045713, filed on Mar. 19, 2021, in the Japan Patent Office, the entire disclosure of which is incorporated by reference herein.

BACKGROUND

Technical Field

Embodiments of the present disclosure relate to a packaging box and a sheet material.

Related Art

A packaging box includes a first pair of side plates facing each other, a second pair of side plates facing each other, an upper plate covering an upper opening of the packaging box, and a bottom plate covering a lower opening of the packaging box.

SUMMARY

This specification describes an improved packaging box that includes a first pair of side plates facing each other, a second pair of side plates facing each other, an upper plate to close an upper opening of the packaging box, a bottom plate to close a lower opening of the packaging box, a folded inward contact flap, and a holding mechanism. The folded inward contact flap is connected to a lateral side of one of the first pair of side plates and folded at the lateral side to be in contact with one of the second pair of side plates. The holding mechanism holds contact between the folded inward contact flap and the one of the second pair of side plates.

This specification further describes an improved sheet material to form a packaging box. The sheet material includes a first pair of side plates facing each other, a second pair of side plates facing each other, an upper plate to close an upper opening of the packaging box, a bottom plate to close a lower opening of the packaging box, a folded inward contact flap, and a holding mechanism. The folded inward contact flap is connected to a lateral side of one of the first pair of side plates and folded at the lateral side to be in contact with one of the second pair of side plates. The holding mechanism holds contact between the one of the second pair of side plates and the folded inward contact flap after the folded inward contact flap is folded.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
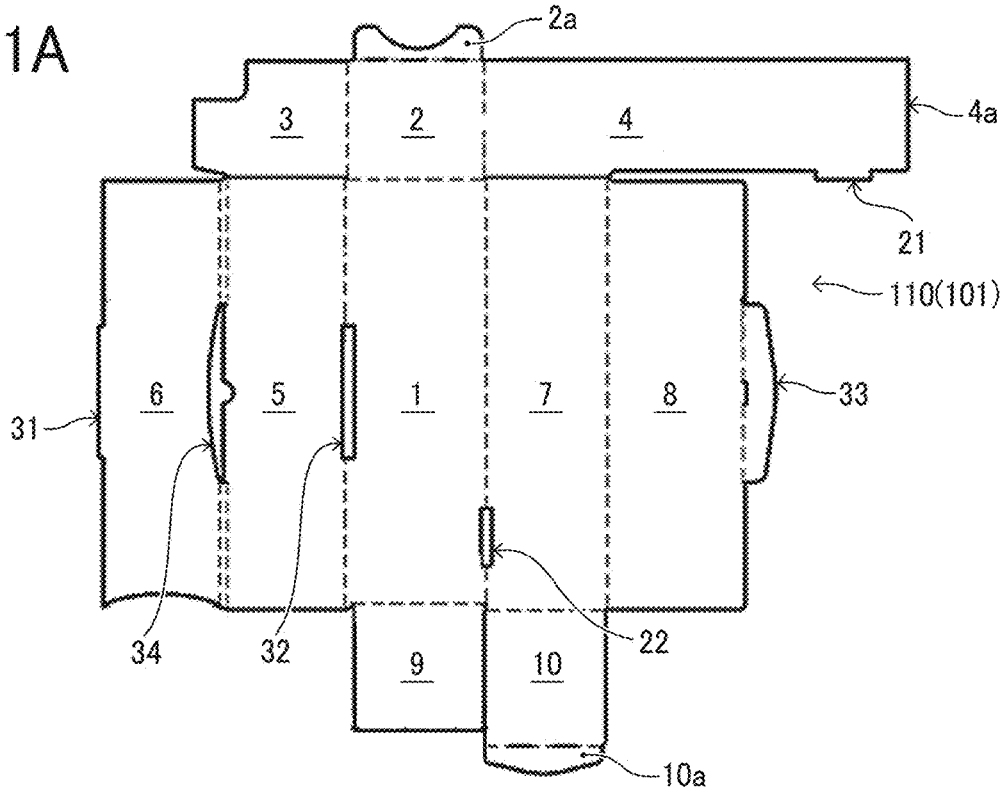
FIG. 1A is a developed view of a blank board of a packaging box according to a first embodiment.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity.

However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below with reference to drawings. Identical reference numerals are assigned to identical components or equivalents and a description of those components is simplified or omitted.

Packaging boxes according to embodiments of the present disclosure each have an opening to insert a packaged object and another opening to take out the packaged object.

First, how to use the packaging box is described.

Figure 9A:
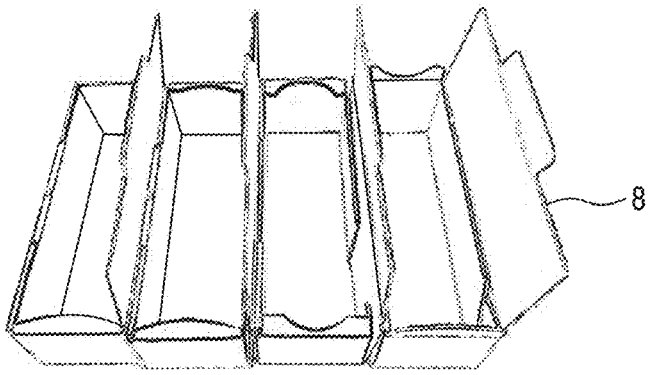
FIGS. 9A to 9C are perspective views of the packaging boxes to illustrate how to use the packaging box.
Figure 9B:
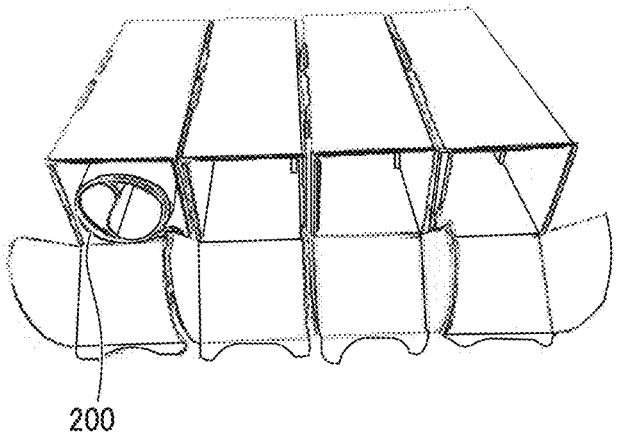

The packaging box includes an upper plate 8 that can open and close an upper opening that is the largest opening of the packaging box. The upper plate 8 is opened to take the packaged object out of the packaging box, and the upper opening is an opening to take the packaged object out of the packaging box. In FIG. 9A, the four packaging boxes are arranged in a short-side direction of the packaging box, and the upper plates 8 are opened. The packaging box includes a front plate that can open and close a front opening that is the smallest opening of the packaging box. The front plate is opened to put the packaged object in the packaging box, and the front opening is an opening into which the packaged object is inserted. In FIG. 9B, the four packaging boxes are arranged in the short-side direction, and the front plates are opened. If the packaged objects are inserted into the plurality of packaging boxes illustrated in FIG. 9A, the upper plate 8 that is a rising portion to open the largest opening of the packaging box lengthens a distance to move the packaged object to the opening. As a result, putting the packaged object in the packaging box becomes difficult. In contrast, a distance to move the packaged object to the opening illustrated in FIG. 9B is shorter than the distance to move the packaged object to the opening illustrated in FIG. 9A. As a result, putting the packaged objects in the openings illustrated in FIG. 9B improves the work efficiency. However, when a worker takes the packaged object out of the packaging box, using the largest opening of the packaging box as the opening to take the packaged object out of the packaging box is desirable because the worker can confirm the entire packaged object in the packaging box.

Figure 9C:
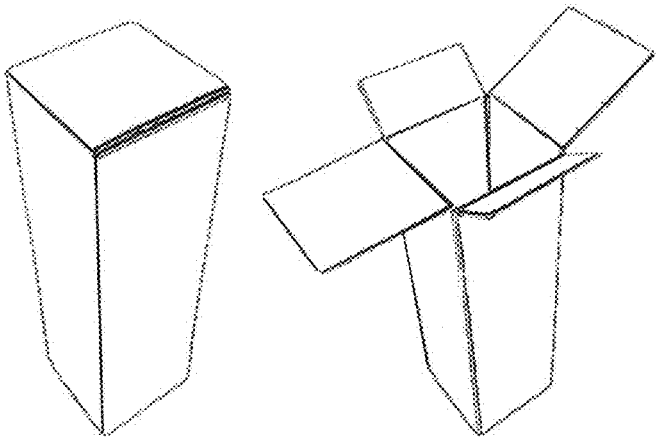

The packaged object is put in the leftmost box of FIG. 9B, and a front end portion of the packaged object is illustrated in FIG. 9B. The packaged object is an endless belt. The endless belt is wound or folded to put the endless belt in the packaging box. The packaging box is vertically placed as illustrated in FIG. 9C during storage to prevent the endless belt from deforming. When the packaged objects are put in the packaging boxes, the above-described packaging boxes vertically placed during storage are arranged side by side as illustrated in FIG. 9B. Note that the packaging box at the right side in FIG. 9C is the vertically placed packaging box of a comparative embodiment.

Figure 1B:
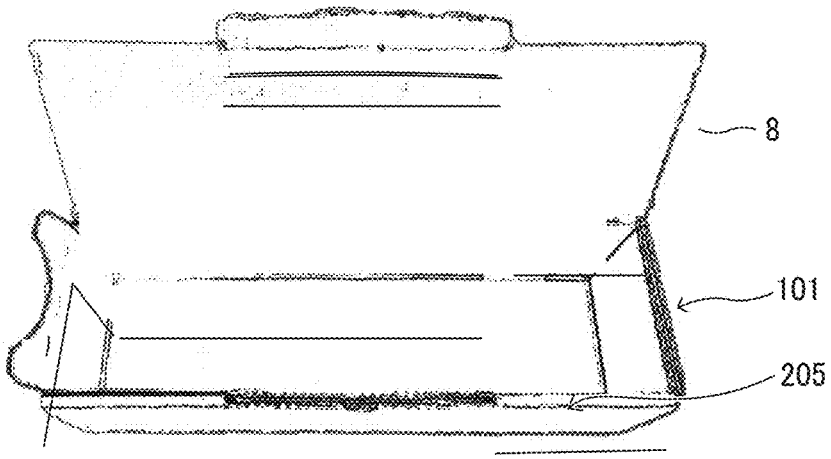
FIG. 1B is a perspective view of the packaging box of FIG. 1A in which an upper plate is opened.
Figure 1C:
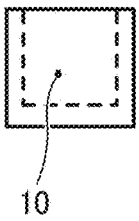
FIG. 1C is a front view of the packaging box of FIG. 1A.

The following describes the packaging box according to a first embodiment of the present disclosure with reference to FIGS. 1A to 1C.

FIG. 1A is a developed view of a blank board 110 made of, for example, corrugated cardboard to make a packaging box 101 according to the first embodiment. FIG. 1B is a perspective view of the packaging box 101. The basic configuration of the packaging box 101 according to the first embodiment includes a first pair of side plates facing each other, a second pair of side plates facing each other, an upper plate closing the upper opening, and a bottom plate closing a lower opening. The packaging box 101 illustrated in FIGS. 1A to 1C has a rectangular parallelepiped shape extending from a front side plate 9 to a back side plate 2 and includes a bottom plate 1 as the bottom plate. The bottom plate 1 and the front side plate 9 have a common front short side, and the bottom plate 1 and the back side plate 2 have a common back short side. The front side plate 9 and the back side plate 2 are the first pair of side plates facing each other. In addition, the blank board 110 of the packaging box 101 illustrated in FIG. 1A includes a left side plate 5 and a right side plate 7 that are the second pair of side plates facing each other. The bottom plate 1 and the left side plate 5 have a common left long side, and the bottom plate 1 and the right side plate 7 have a common right long side. Each of the four sides that are the front, back, left, and right sides of the bottom plate 1 serves as a folding line portion (hereinafter, the folding line portion is also referred to as a fold line) of the bottom plate and the side plate connected to the bottom plate. The names of the respective plates in the above are names based on front and back, left and right, and upper and bottom when the packaging box is placed with the relatively larger opening facing upward and the relatively smaller opening facing forward. Each of the relatively larger opening and the relatively smaller opening can be opened and closed by the corresponding side plate.

The blank board 110 includes the upper plate 8 connected to the right side of the right side plate 7 serving as the fold line. The right side of the right side plate 7 is an upper side line of the packaging box 101. The upper plate 8 can open and close the upper opening of the packaging box 101. The front side plate 9 serves as the lateral lid flap that can open and close the front opening of the packaging box 101 serving as a lateral opening of the packaging box. The blank board 110 includes an outer lid flap 10 connected to the lower side of the right side plate 7 in FIG. 1A. The lower side of the right side plate 7 serves as the fold line. The lower side of the right side plate 7 is a front side line of the packaging box 101. The outer lid flap 10 covers the outside of the front side plate 9.

The blank board 110 includes a folded inward contact flap 4 connected to the right side of the back side plate 2 serving as the fold line. A folded inward contact flap such as the folded inward contact flap 4 is connected to a side of one of the first pair of side plates and in contact with the inner surface of one of the second pair of side plates. The folded inward contact flap 4 includes a projection 21 projecting downward from the lower side of the folded inward contact flap 4 and being disposed near the end of the folded inward contact flap 4. The bottom plate 1 has a cutout hole 22 into which the projection 21 is inserted. The cutout hole 22 is at a position facing the projection 21 in the packaging box assembled. Instead of or in addition to the projection and the cutout hole illustrated in FIG. 1A, the projection 21 may be disposed on the upper side of the folded inward contact flap 4 so as to project upward, and the cutout hole 22 may be disposed at a corresponding position of the upper plate 8. A projection such as the projection 21 is disposed on at least one of the upper side of the folded inward contact flap or the lower side of the folded inward contact flap. A cutout hole into which the projection is inserted, such as the cutout hole 22 is disposed in at least one of the upper plate or the bottom plate. The projection and the cutout hole are a holding mechanism to hold the folded inward contact flap 4 to be in contact with one of the second pair of side plates. In other words, the projection and the cutout hole functions as the holding mechanism holding contact between the folded inward contact flap and one of the second pair of side plates.

The length of the folded inward contact flap 4 is set so that the end of the folded inward contact flap 4 is located at a position easily visible from the outside of the packaging box through the front opening opened by opening the front side plate 9. For example, the length of the folded inward contact flap 4 may be designed so that the edge face on the end of the folded inward contact flap 4 meets the edge that forms the front opening. In this case, the edge face on the end of the folded inward contact flap 4 is in contact with the inner surface of the front side plate 9 as the lateral lid flap.

In addition, the blank board 110 includes a folded flap 6 connected to the left side of the left side plate 5 serving as the fold line. In the assembly of the packaging box 101, the left side of the left side plate 5 is an upper side line of the packaging box, and the blank board 110 is folded back at the upper side line so that the folded flap 6 is in contact with the inner surface of the left side plate 5. The blank board 110 includes a tongue portion 2*a* connected to the upper side of the back side plate 2 and an insertion flap 3 connected to the left side of the back side plate 2. The blank board 110 also includes a tip projection 31 connected to the tip of the folded flap 6, a cutout hole 32 formed in the bottom plate 1, and a tongue portion 33 connected to the tip of the upper plate 8. The tip projection 31 is inserted into the cutout hole 32.

FIG. 1B is a perspective view of the packaging box 101 in which the upper plate 8 is opened to open the upper opening 205. In the state as illustrated in FIG. 1B, the packaged object in the packaging box is taken out. The packaged object is put in the packaging box through the front opening. The above is described in detail later.

Figure 2A:
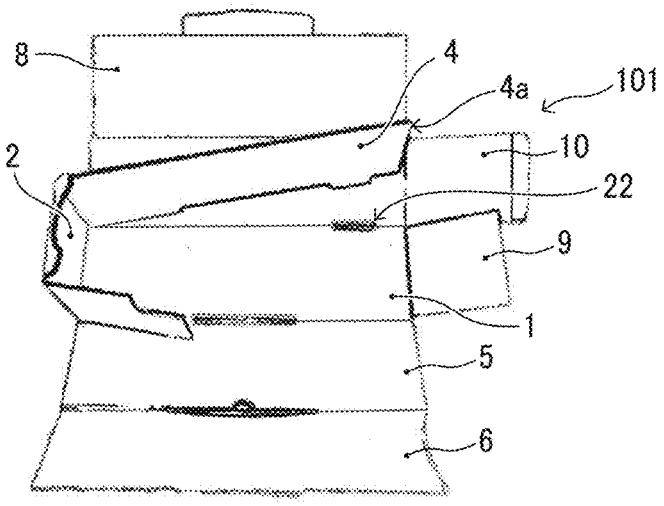
FIGS. 2A to 2C are perspective views of the packaging box of FIGS. 1A to 1C to illustrate assembly procedures of the packaging box.
Figure 2B:
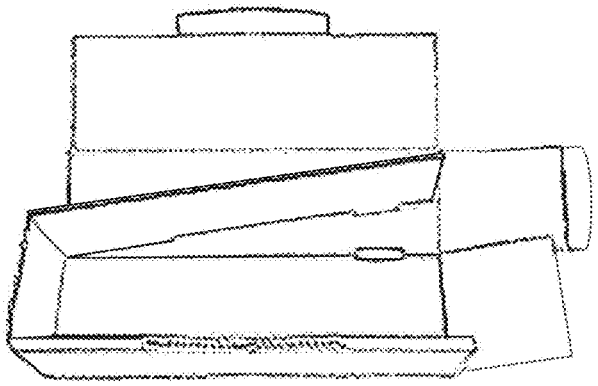

FIGS. 2A to 2C and 3A to 3D are perspective views of the packaging box 101 to illustrate assembly procedures of the packaging box 101. As illustrated in FIG. 2A, the back side plate 2 is raised and folded. As illustrated in FIG. 2B, the left side plate 5 is raised, the folded flap 6 is folded back so as to insert the insertion flap 3 into a space between the left side plate 5 and the folded flap 6, and the tip projection 31 of the folded flap 6 is inserted into the cutout hole 32.

Figure 2C:
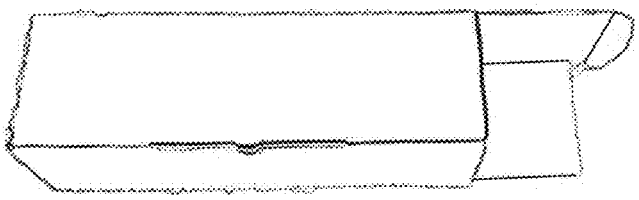

As illustrated in FIG. 2C, the right side plate 7 is raised, the projection 21 of the folded inward contact flap 4 is inserted into the cutout hole 22, and the tongue portion 33 attached to the upper plate 8 is inserted into the cutout hole 34 between the left side plate 5 and the folded flap 6. In the state illustrated in FIG. 2C, the packaged object is put in the packaging box.

Figure 3A:
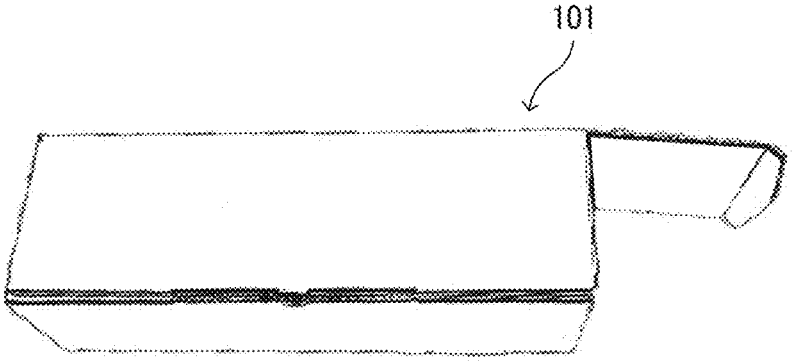
FIGS. 3A to 3D are perspective views of the packaging box of FIGS. 1A to 1C to illustrate assembly procedures of the packaging box after a packaged object is put in the packaging box.
Figure 3B:
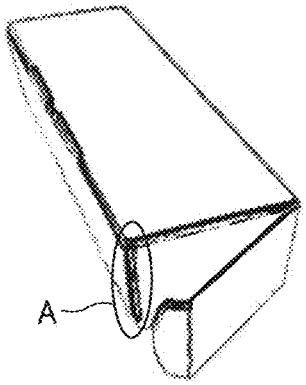
Figure 3C:
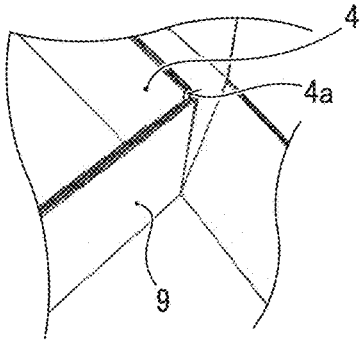
Figure 3D:
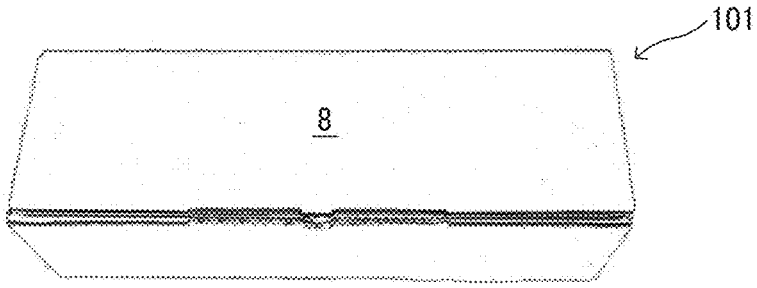

After the packaged object is put in the packaging box, the front side plate 9 is raised and folded so that the packaging box 101 becomes as illustrated in FIG. 3A. Next, the outer lid flap 10 is folded, and a tongue portion 10*a* on the tip of the outer lid flap 10 is inserted into a space between the left side plate 5 and the folded flap 6 that is the space at the portion surrounded by the circle A in FIG. 3B. FIG. 3B is the perspective view viewed from an angle different from the perspective view of FIG. 3A. The length from the tip of the tongue portion 10*a* to the lower side line of the outer lid flap 10 is designed to have a length so that the tongue portion 10*a* is surely hooked on the insertion portion and not easily pulled out from the insertion portion, and the tongue portion 10*a* is tapered so as to be easily inserted. FIG. 3D illustrates the packaging box after the procedures to put the packaged object in the packaging box is completed.

FIGS. 3A and 3B illustrates the packaging box after the front side plate 9 as an inner lid of the packaging box of FIG. 2C is folded. As illustrated in FIG. 3C, the end of the inner surface of the folded inner lid hits the end 4*a* of the folded inward contact flap 4. The contact between the folded inner lid and the end 4*a* of the folded inward contact flap 4 prevents the inner lid from falling further inward. FIG. 3C is a partial perspective view of the packaging box with the upper plate 8 as an upper lid opened around a portion in which the folded inner lid contacts the end 4*a* of the folded inward contact flap 4 so that the positional relationship can be easily seen. FIG. 3D is a perspective view of the packaging box after the assembly procedures are completed.

Figure 13A:
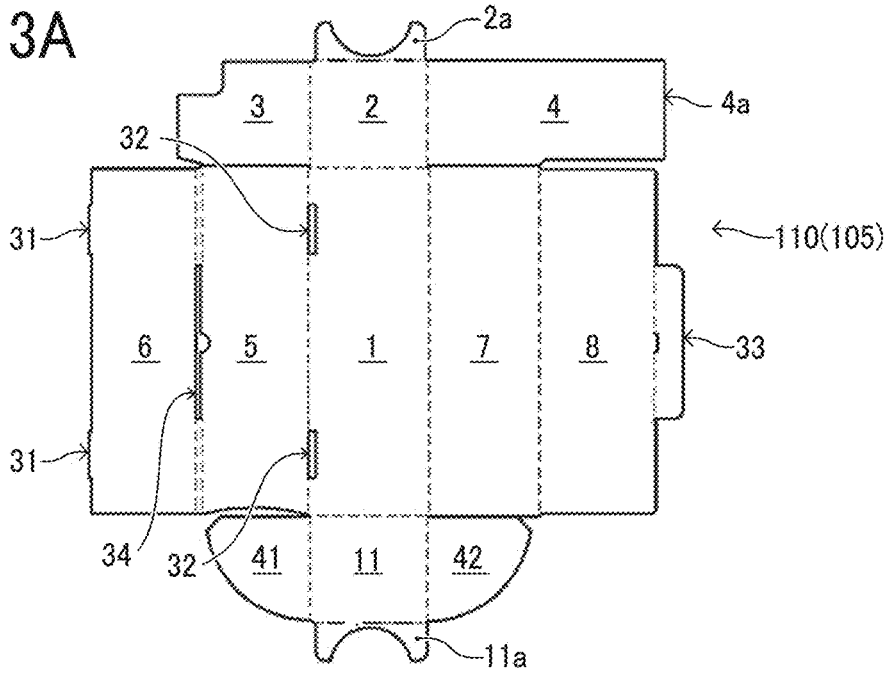
FIG. 13A is a developed view of a blank board of a packaging box according to a comparative embodiment.
Figure 13B:
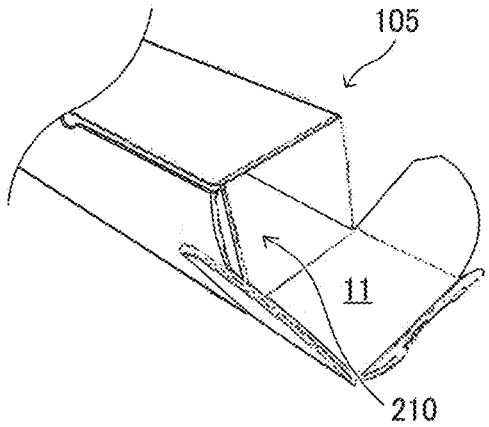
FIG. 13B is a partial perspective view of the packaging box of FIG. 13A that is opened to insert a packaged product.

With reference to FIGS. 13A to 13D, a packaging box according to a comparative embodiment is described. FIG. 13A is a developed view of a blank board 110 of a packaging box 105 according to the comparative embodiment, FIG. 13B is a partial perspective view of the packaging box 105 that is opened to insert the packaged object, and FIG. 13E is a front view of the packaging box 105 in which the opening to insert the packaged object is closed. As illustrated in FIG. 13A, the length of the folded inward contact flap 4 is shorter than the length of the folded inward contact flap 4 of the packaging box of the first embodiment illustrated in FIG. 1A. As a result, the end 4*a* of the folded inward contact flap 4 is in the back of the packaging box 105 far from the front opening as an opening to insert the packaged object. It is difficult to find the end 4*a* of the folded inward contact flap 4. That is, it is not easy to visually check the end 4*a* of the folded inward contact flap 4. This is because the end 4*a* of the folded inward contact flap 4 is not located at a position easily visible from the opening of the packaging box 105. Therefore, the worker cannot find the end 4*a* unless the worker looks into the packaging box 105.

Figure 13C:
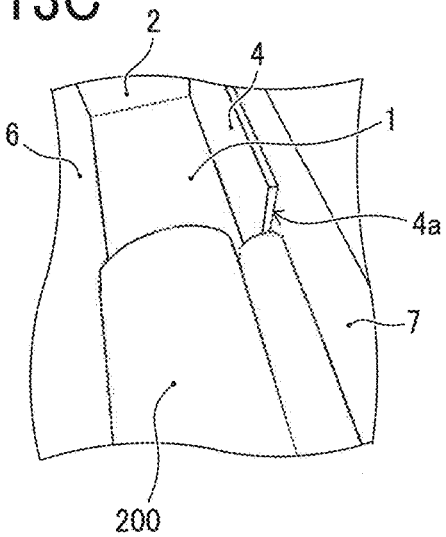
FIG. 13C is a partial perspective view of an inside of the packaging box of FIG. 13A in which the upper plate is opened.
Figure 13D:
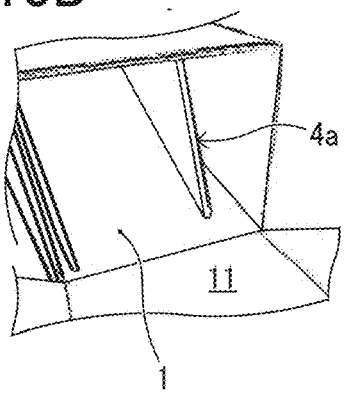
FIG. 13D is a partial perspective view of a packaging box according to the comparative embodiment including the folded inward contact flap longer than the folded inward contact flap of the packaging box of FIG. 13A.
Figure 13E:
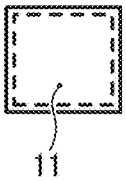
FIG. 13E is a front view of the packaging box of FIG. 13A.

With reference to FIG. 13C, the following describes a disadvantage in the comparative embodiment. As illustrated in FIG. 13C, the end 4*a* of the folded inward contact flap 4 may separate from the right side plate 7, shift to the inside of the packaging box, and be positioned near the center of the packaging box. When the packaged object like a scroll is inserted into the packaging box, the packaged object may hit the end 4*a* positioned near the center of the packaging box. As a result, the packaged object may be damaged. FIG. 13C illustrates the packaging box with the upper plate 8 opened, but the upper plate 8 is originally closed. Even when the length of the folded inward contact flap 4 is set to be relatively longer as illustrated in FIG. 13D, the above-described disadvantage occurs as long as the end 4*a* of the folded inward contact flap 4 is positioned near the center of the packaging box.

In contrast, the packaging box 101 according to the first embodiment includes the projection 21 on the folded inward contact flap 4. The projection 21 is inserted into the cutout hole 22 to hold the contact between the right side plate 7 and the folded inward contact flap 4. Therefore, the end 4*a* of the folded inward contact flap 4 is not positioned near the center of the packaging box 101. As a result, the packaging box 101 according to the first embodiment can prevent the occurrence of the above-described disadvantage. In addition, the length of the folded inward contact flap 4 of the packaging box 101 according to the first embodiment are set such that the end 4*a* of the folded inward contact flap 4 is positioned to be seen from the smallest opening. As a result, the worker can put the packaged object into the packaging box so that the packaged object does not hit the end 4*a* of the folded inward contact flap 4. That is, the thickness of the corrugated cardboard of the folded inward contact flap 4 in contact with the inner surface of the right side plate 7 does not cause the interference between the end 4*a* of the folded inward contact flap 4 and the packaged object put into the packaging box, and the packaged object is not damaged.

Figure 4A:
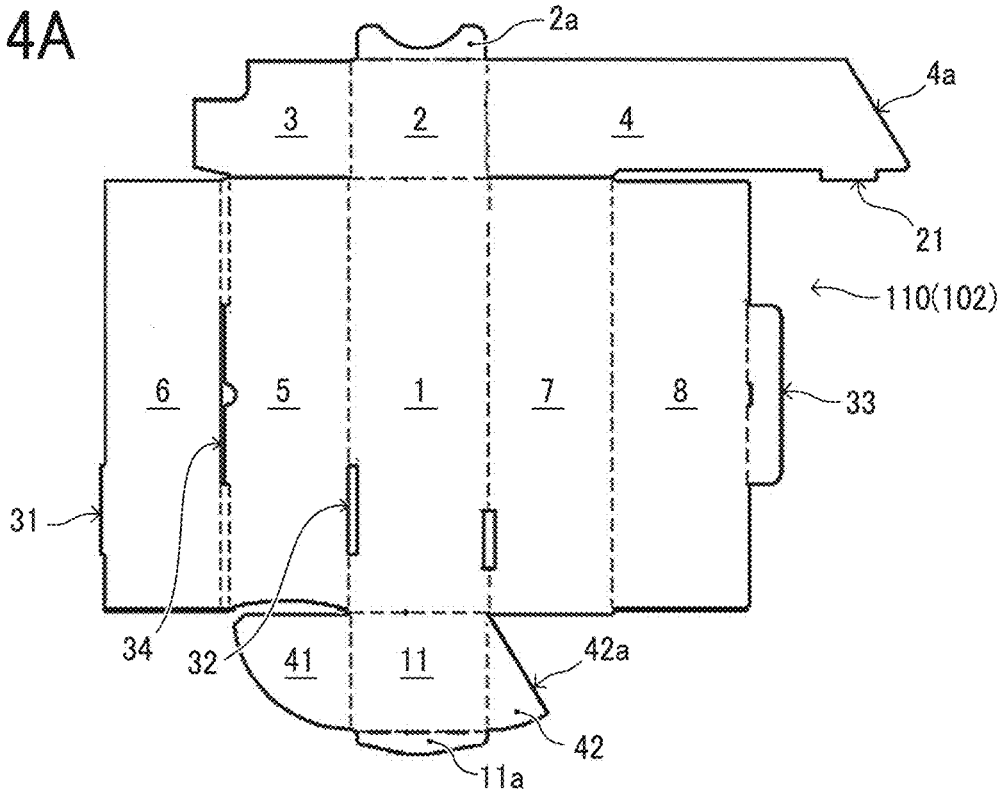
FIG. 4A is a developed view of a packaging box according to a second embodiment.
Figure 4B:
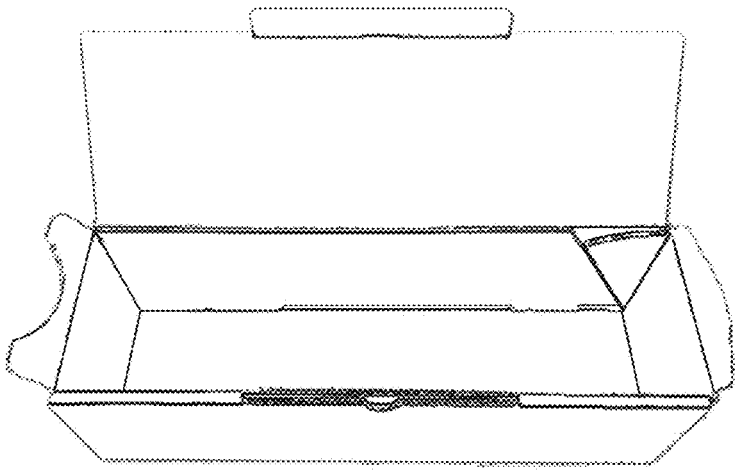
FIG. 4B is a perspective view of the packaging box of FIG. 4A in which the upper plate is opened.
Figure 4C:
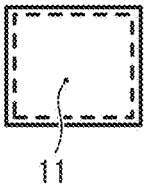
FIG. 4C is a front view of the packaging box of FIG. 4A.

Next, a packaging box 102 according to a second embodiment of the present disclosure is described with reference to FIGS. 4A to 4C. A difference between the packaging box 101 of the first embodiment and the packaging box 102 of the second embodiment is as follows. The end 4*a* of the folded inward contact flap 4 has a tapered shape as illustrated in FIG. 4A. The packaging box 102 includes a front side plate 11 as the lateral lid flap covering the front opening as the opening to insert the packaged object. The front side plate 11 includes a tongue portion 42 including the end 42*a* having a tapered shape corresponding to the tapered shape of the end 4*a* of the folded inward contact flap 4 as illustrated in FIG. 4B. That is, the lateral lid flap includes the tongue portion 42 as a folded portion that is in contact with the right side plate 7 as one of the second side plates when the lateral lid flap closes the front opening as the lateral opening, and the end 4*a* of the folded inward contact flap 4 and the end 42*a* of the tongue portion 42 have tapered shapes facing each other.

The sealing structure of the lateral lid flap of the opening to insert the packaged object is also different from that of the first embodiment. As illustrated in FIG. 4A, the packaging box 102 includes tongue portions 41, 11*a*, and 42 on three sides of the front side plate 11, which is the lateral lid flap, other than the side of the front side plate 11 that is the fold line between the bottom plate 1 and the front side plate 11. Folding back the tongue portions causes the tongue portions to enter the opening to insert the packaged object and come into contact with the inner surfaces of the side plates to form contact regions. Folded portions are on all four sides of the front side plate 11. One of the folded portions is connected to the bottom plate 1 that is one of side plates. The other three folded portions are connected to tongue portions in contact with the inner surfaces of the side plates. As illustrated by the dashed line in FIG. 4C, the folded portions are formed on all four sides of the front side plate 11, and gaps are less likely to be formed. The packaging box of the comparative embodiment illustrated in FIGS. 13A to 13E has the same sealing structure of the lid covering the opening to insert the packaged object as illustrated in FIG. 13E. The folded portions formed on all four sides of the front side plate 11 are indicated by broken lines in FIG. 13E.

Also, in the packaging box 102 of the second embodiment, the folded inward contact flap 4 extends to the vicinity of the opening to insert the packaged object so that the end of the folded inward contact flap 4 can be easily visually observed from the opening to insert the packaged object. The end 4*a* of the folded inward contact flap 4 and the tongue portion 42 are tapered so as not to overlap each other in the thickness direction of the folded inward contact flap 4 and the tongue portion 42. Contact between the tapered end faces of the folded inward contact flap 4 and the tongue portion 42 prevents the side of the tongue portion 42 of the front side plate 11 from entering the inside of the packaging box 102.

Figure 5A:
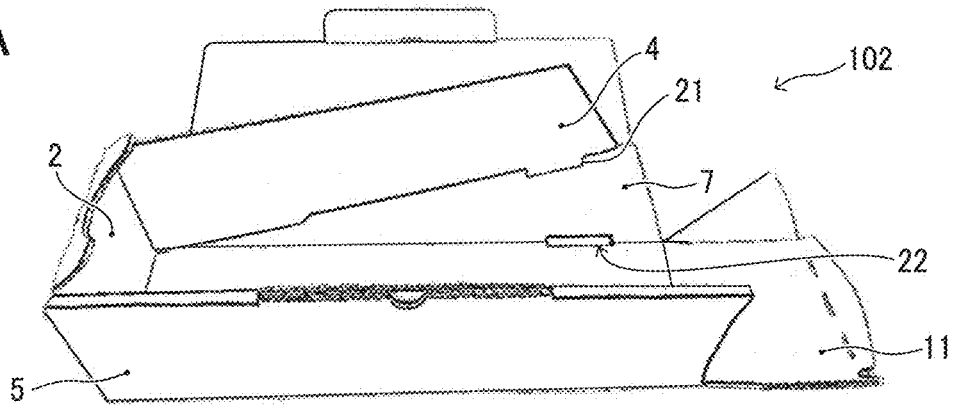
FIGS. 5A to 5D are perspective views of the packaging box of FIGS. 4A to 4C to illustrate assembly procedures of the packaging box.

FIGS. 5A to 5D are perspective views of the packaging box 102 according to the second embodiment to illustrate assembly procedures. The following procedures are basically the same as the assembling procedures of the packaging box 101 of the first embodiment described with reference to FIGS. 2A to 2C and 3A to 3D. As illustrated in FIG. 5A, the back side plate 2 and the left side plate 5 are raised, the folded flap 6 is folded back so as to insert the insertion flap 3 into a space between the left side plate 5 and the folded flap 6. The tip projection 31 of the folded flap 6 is inserted into the cutout hole 32. The right side plate 7 is raised, the projection 21 of the folded inward contact flap 4 is inserted into the cutout hole 22, and the tongue portion 33 attached to the upper plate 8 is inserted into the cutout hole 34 between the left side plate 5 and the folded flap 6. In this state, the packaged object is put in the packaging box.

Figure 5B:
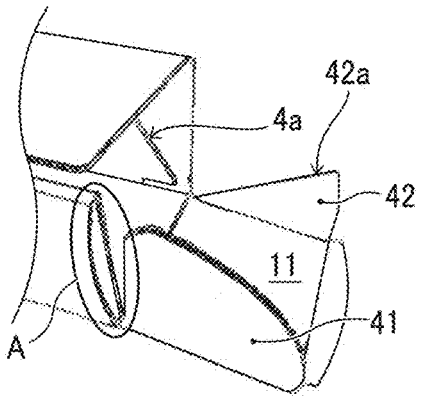
Figure 5C:
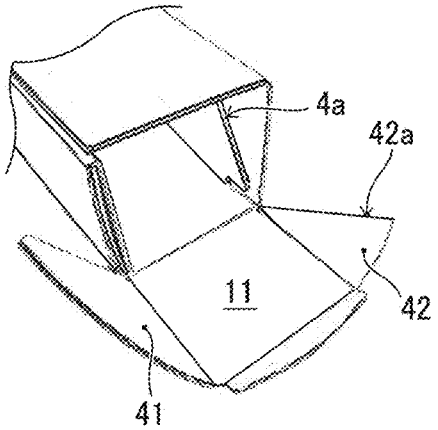
Figure 5D:
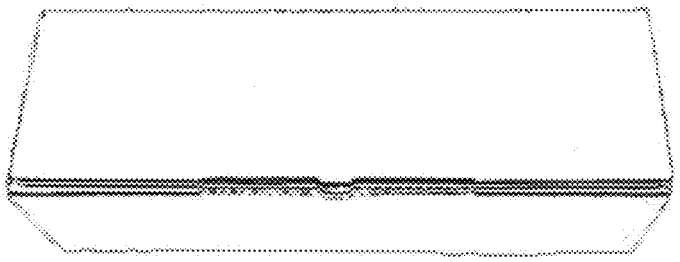

As illustrated in FIG. 5B, the front side plate 11 is raised, and the tongue portion 41 is inserted into a gap (a portion indicated by a circle A in FIG. 5B) formed between the left side plate 5 and the folded flap 6. FIG. 5C is a partial perspective view of the packaging box viewed from an angle different from an angle in FIG. 5B. FIG. 5D is a perspective view of the packaging box after the assembly procedures are completed. Similar to the first embodiment, instead of or in addition to the projection and the cutout hole illustrated in FIG. 4A, the projection 21 may be disposed on the upper side of the folded inward contact flap 4 so as to project upward, and the cutout hole 22 may be disposed at a corresponding position of the upper plate 8.

Figures 6A, 6B:
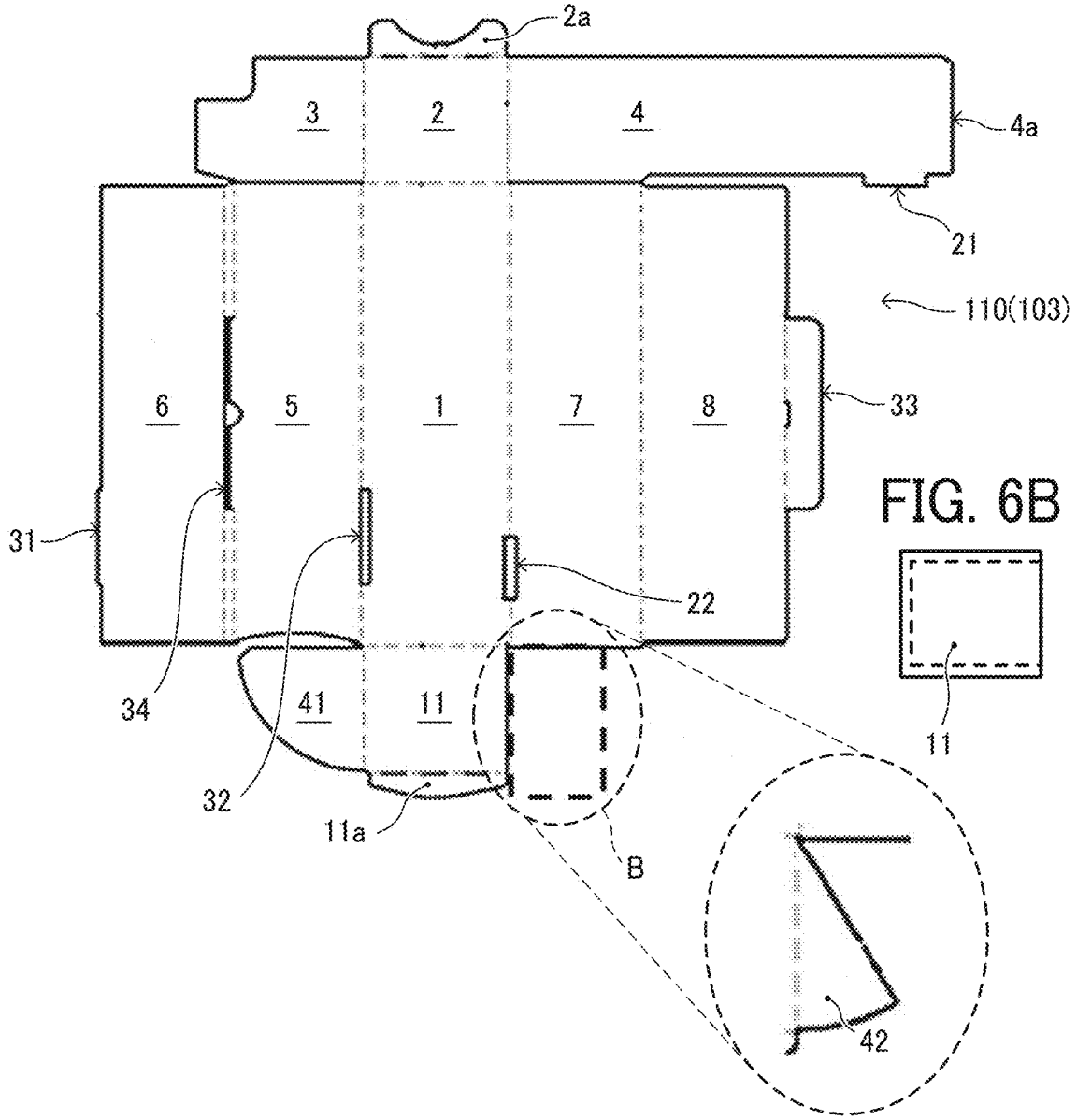
FIG. 6A is a developed view of a packaging box according to a third embodiment.
FIG. 6B is a front view of the packaging box of FIG. 6A.

Next, a packaging box 103 according to a third embodiment of the present disclosure is described with reference to FIGS. 6A and 6B. FIG. 6A is a developed view of the packaging box 103, and FIG. 6B is a front view of the packaging box 103.

In the packaging box 103 according to the third embodiment, the end 4*a* of the folded inward contact flap 4 is not tapered. The end 4*a* of the folded inward contact flap 4 has a straight line. In order to avoid overlapping of the folded inward contact flap 4 and the tongue portion 42 in the thickness direction, the tongue portion 42 that is in a range surrounded by a circle B in FIG. 6A is removed. The folded inward contact flap 4 in the packaging box 103 according to the third embodiment can be held to be in contact with the right side plate 7 as in the first embodiment and the second embodiment.

The packaging box 101 according to the first embodiment as illustrated in FIGS. 1A to 1C has a double structure including the front side plate 9 as an inner lid and the outer lid flap 10 as an outer lid so as not to form a gap at the right side of the front side plate 9. In addition, the packaging box 101 includes the outer lid flap 10 extended from the right side plate 7 via the folded portion and the tongue portion 10*a* formed at the tip of the outer lid. Inserting the tongue portion 10*a* formed at the tip of the outer lid into the gap between the left side plate 5 and the folded flap 6 prevents occurrence of the gap. FIG. 1C is a front view of the packaging box having the opening to insert the packaged object. As illustrated in FIG. 1C, the packaging box includes a folded portion connected to the right side plate at the right side of the packaging box. The packaging box also includes a folded portion connected to the tongue portion at the left side of the packaging box.

Figure 7A:
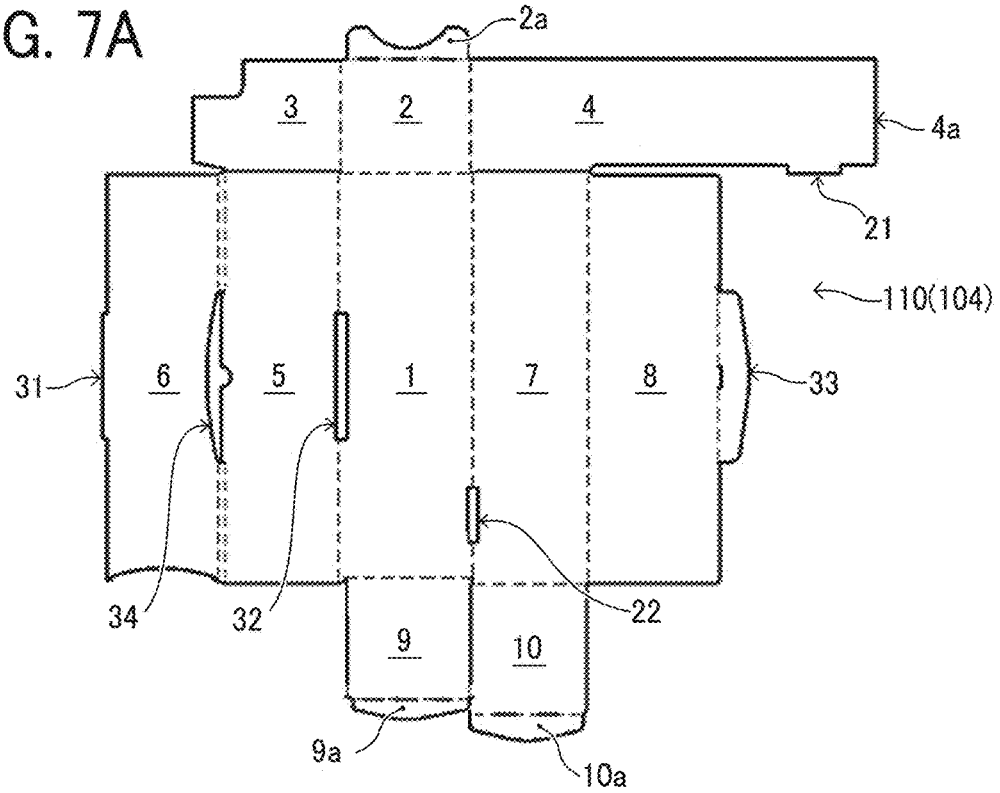
FIG. 7A is a developed view of a packaging box according to a fourth embodiment.
Figure 7B:
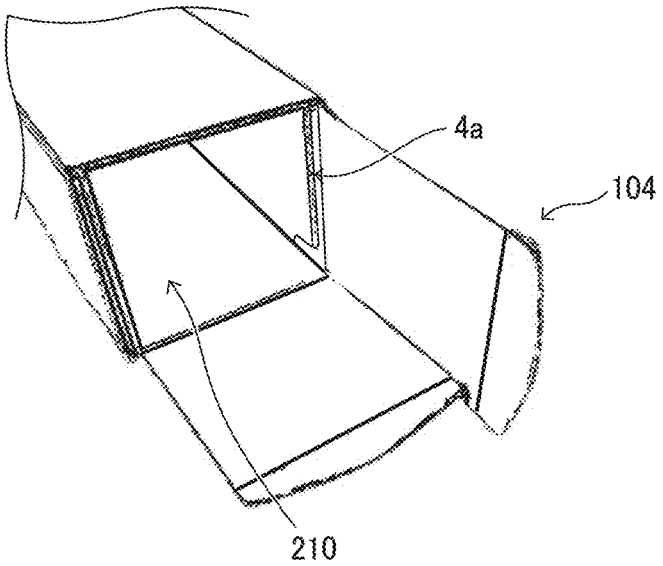
FIG. 7B is a partial perspective view of the packaging box of FIG. 7A.
Figure 7C:
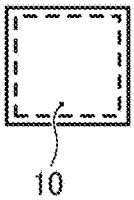
FIG. 7C is a front view of the packaging box of FIG. 7A.

The following describes the packaging box 104 according to a fourth embodiment of the present disclosure with reference to FIGS. 7A to 7C.

FIG. 7A is a developed view of the blank board 100 of the packaging box 104. FIG. 7B is a partially enlarged perspective view of the packaging box 104. FIG. 7C is a front view of the packaging box 104. The packaging box 104 is different from the packaging box of the first embodiment in that a tongue portion 9*a* is formed at the lower side of the front side plate 9 as illustrated in FIG. 7A. As illustrated in FIG. 7B, the opening 210 to insert the packaged object is covered by the outer lid flap 10 and the front side plate 9, and the tongue portion 9*a* is in contact with the upper plate 8 to cover the gap at the upper side between the front side plate 9 and the upper plate 8. As illustrated in FIG. 7C, there are four folded portions at the four sides of the front side plate 9. The other points are the same as those of the packaging box 101 of the first embodiment.

Figure 14:
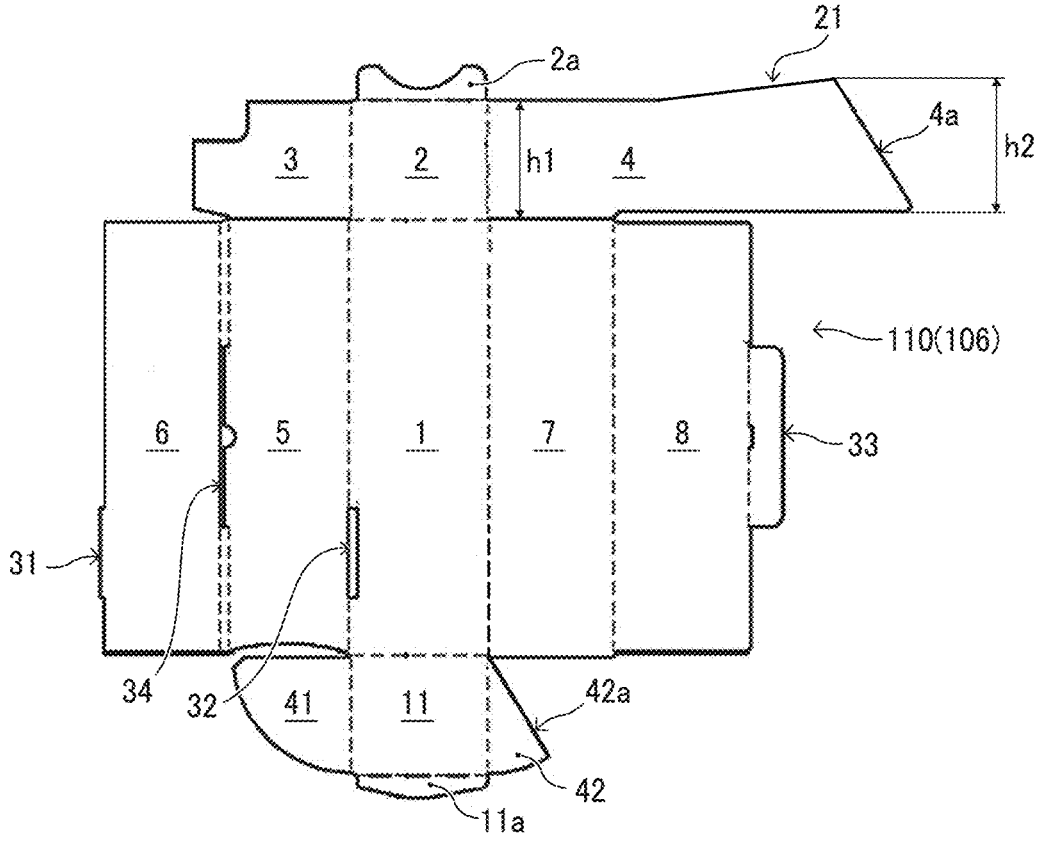
FIG. 14 is a developed view of a blank board of a packaging box according to a fifth embodiment.

The following describes the packaging box 106 according to a fifth embodiment of the present disclosure with reference to FIG. 14.

FIG. 14 is a developed view of a blank board of the packaging box 106 according to the fifth embodiment. The packaging box 106 according to the fifth embodiment has a holding mechanism different from the holding mechanism of the packaging box 102 according to the second embodiment. As illustrated in FIG. 14, a height h2 of the end 4*a* of the folded inward contact flap 4 is larger than a height h1 of the side of the folded inward contact flap 4 connected to the back side plate 2, and the folded inward contact flap 4 has the projection 21. The projection 21 is a portion having a height larger than the height h1 and disposed from a middle portion of the folded inward contact flap 4 to the end 4*a* of the folded inward contact flap 4. In the assembled packaging box 106, the projection 21 is compressed, which increases the friction force between the folded inward flap 4 and the bottom plate 1 and the friction force between the folded inward flap 4 and the upper plate 8 to hold the folded inward contact flap 4 to be in contact with the right side plate 7 as one of the second pair of side plates. As a result, the projection 21 as the holding mechanism prevents the end 4*a* of the folded inward contact flap 4 from being positioned near the center of the packaging box. Instead of the projection 21, at least one of a contact portion of the bottom plate 1 that is in contact with the folded inward contact flap 4 or a contact portion of the folded inward contact flap 4 that is in contact with the bottom plate 1 may have a different shape from the above-described embodiments or be made of different material from other parts of the packaging box 106 to increase friction forces. The other points are the same as those of the packaging box 102 of the first embodiment.

The following describes the comparison between the first embodiment and the second embodiment.

Figure 8A:
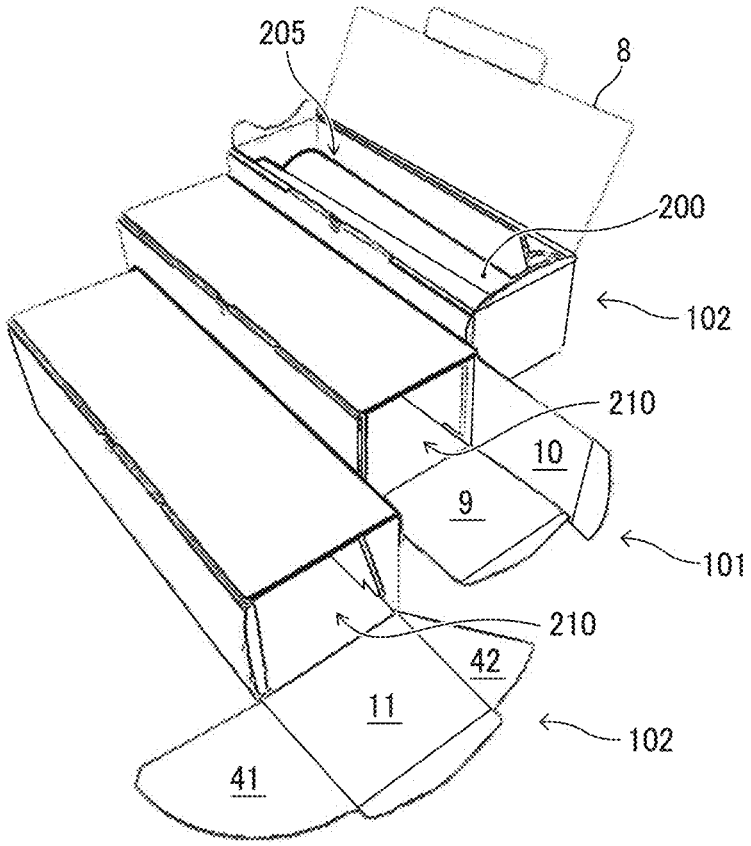
FIGS. 8A and 8B are perspective views of the packaging boxes illustrated in FIGS. 1A to 1C, and 4A to 4C to compare the packaging boxes.
Figure 8B:
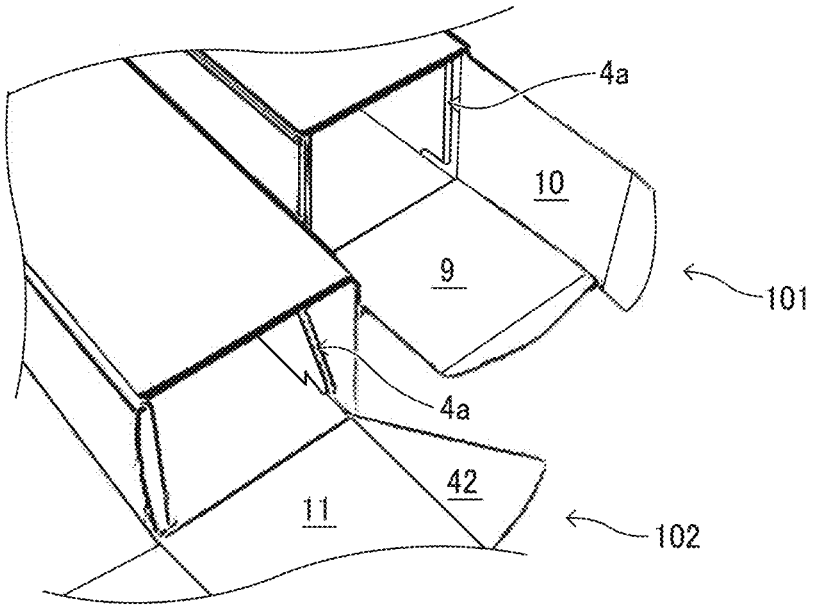

FIG. 8A is a perspective views of the packaging box 101 according to the first embodiment that opens the opening 210 to insert the packaged object and the packaging boxes 102 according to the second embodiment. In FIG. 8A, one of the packaging boxes 102 opens the opening 210 to insert the packaged object and the other one of the packaging box 102 opens the upper opening 205 to take the packaged object 200 out of the packaging box 102. FIG. 8B is a partial perspective view of the packaging boxes 101 and 102 that each open the opening 210 to insert the packaged object. The packaging boxes according to both the first embodiment and the second embodiment includes the folded inward contact flaps 4. The folded inward contact flap 4 has the length so as to locate the end 4*a* of the folded inward contact flap 4 at the position at which the worker can see the end 4*a* in the opening 210 and put the packaged object in the packaging box. The packaging box 101 according to the first embodiment has a straight end 4*a* as illustrated in FIGS. 8A and 8B. In contrast, the packaging box 102 according to the second embodiment has an inclined end 4*a* as illustrated in FIGS. 8A and 8B.

As illustrated in FIGS. 8A and 8B, the worker can easily see the end 4*a* of the folded inward contact flap 4 of the packaging boxes according to both the first and the second embodiments. This is because the end 4*a* of the folded inward contact flap 4 is located at a position at which the worker can see and easily confirm the end 4*a* in the opening 210 to insert the packaged object. As can be seen from a comparison of structures around the openings 210 of the first and second embodiments, the packaging box 102 according to the second embodiment has a smaller number of obstacles around the opening 210 than that of the packaging box 101 according to the first embodiment. The absence of obstacles in a lateral direction of the opening to insert the packaged object greatly improves workability when the worker inserts the packaged objects into four packaging boxes having the openings opened and arranged in the lateral direction as illustrated in FIG. 9B, eight packaging boxes with four boxes stacked vertically to form a two-tiered structure, or twelve packaging boxes with four packaging boxes stacked vertically to form a three-tiered structure. On the other hand, the packaging box 101 according to the first embodiment has an excellent visibility of the folded inward contact flaps 4. This is because the end 4*a* is not cut and does not have the tapered shape, and the worker can see the edge face of the straight end 4*a* from the upper end to the lower end.

Figure 10A:
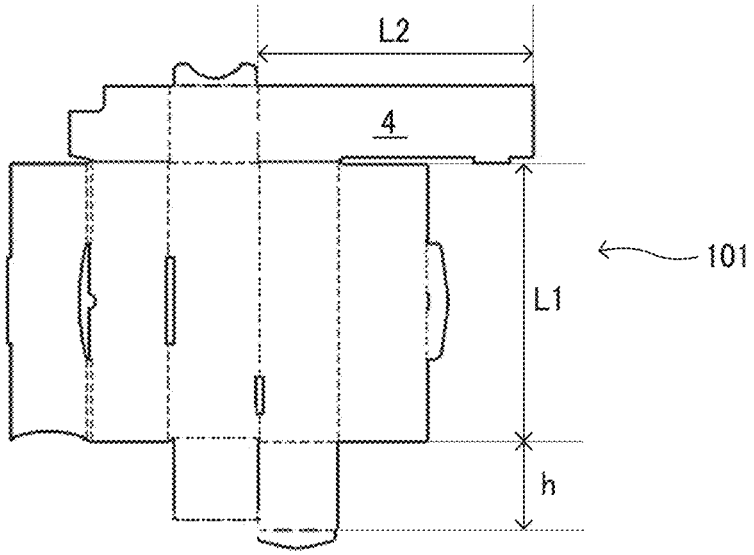
FIG. 10A is the developed view of the packaging box of FIGS. 1A to 1C illustrating the length of a folded inward contact flap of the packaging box.
Figure 10B:
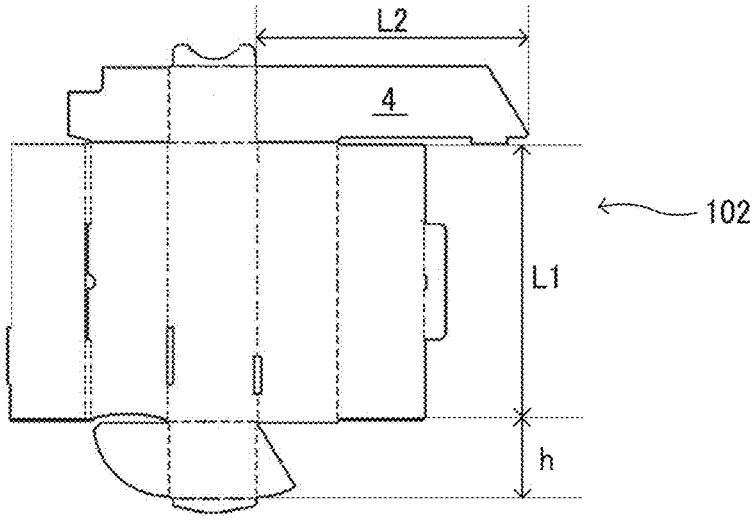
FIG. 10B is the developed view of the packaging box of FIGS. 4A to 4C illustrating the length of the folded inward contact flap of the packaging box.
Figure 10C:
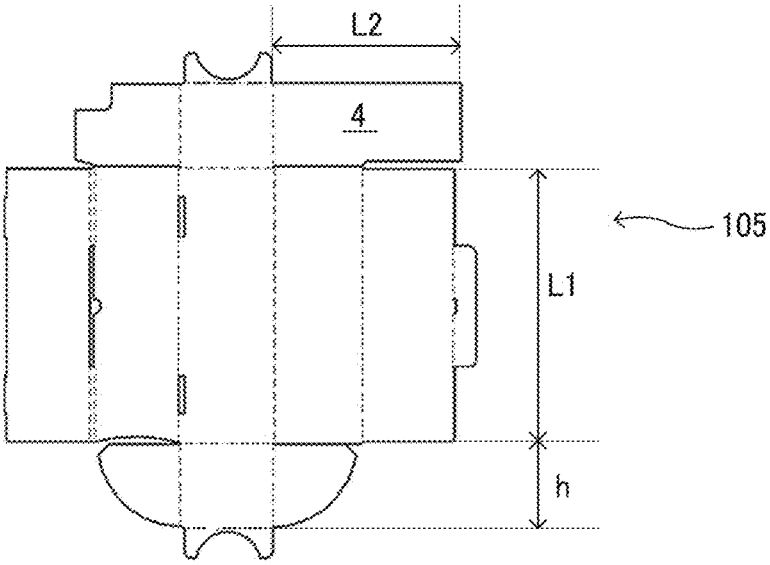
FIG. 10C is the developed view of a packaging box according to a comparative embodiment illustrating the length of the folded inward contact flap of the packaging box.

With reference to FIGS. 10A to 10C, the following describes a length L2 of the folded inward contact flap 4 disposed at a position at which the worker can see the end 4*a* of the folded inward contact flap 4 in the front opening. The worker can see the end 4*a* when the length L2 is longer than (L1−h), where L1 is a length of the packaging box, and h is a height of the front opening. FIG. 10A is the developed view of the packaging box 101 according to the first embodiment illustrating the lengths of parts of the packaging box 101. FIG. 10B is the developed view of the packaging box 102 according to the second embodiment illustrating the lengths of parts of the packaging box 102. FIG. 10C is the developed view of the packaging box 105 according to the comparative embodiment illustrating the lengths of parts of the packaging box 105 that is also illustrated in FIG. 13. The packaging boxes 101 and 102 of the first and second embodiments each have the length L2 longer than (L1−h). In contrast, the packaging box of the comparative embodiment has the length L2 shorter than (L1−h).

Figure 11:
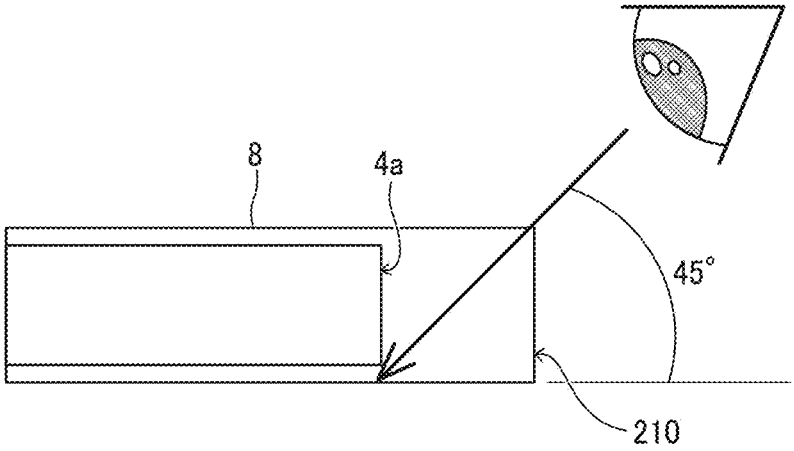
FIG. 11 is a schematic diagram illustrating an angle at which a worker views the packaging box.

As illustrated in FIG. 11, the magnitude relation described above is the relation among L1, h, and L2 when the worker views the packaging box at 45 degrees above a placement surface on which the packaging box is placed.

Figure 12A:
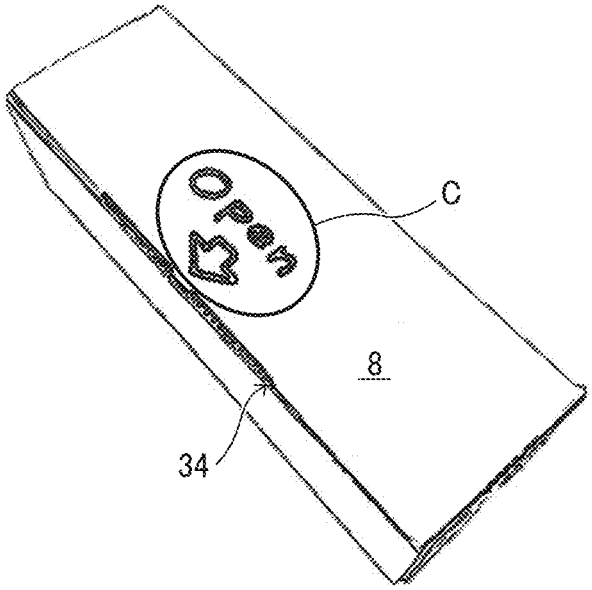
FIGS. 12A and 12B are perspective views of packaging boxes according to variations.
Figure 12B:
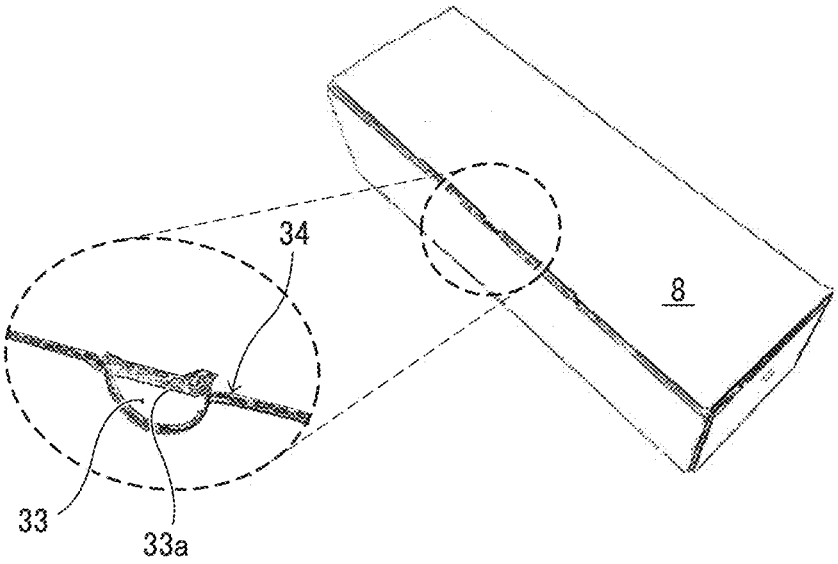

With reference to FIGS. 12A and 12B, the following describes variations of the above embodiments. When the packaging box is placed, the side facing upward is generally a top surface that is the surface of the upper plate 8 or a side surface that is the surface of the left side plate 5 or the surface of the right side plate 7. In order to open the packaging box, the packaging box is placed with the surface of the upper plate 8 facing up, that is, the top surface facing up. Each of the packaging boxes of the variations has a structure that guides the worker to place the packaging box with the top surface facing up. The packaging box as illustrated in FIG. 12A includes a character such as "Open" or a symbol such as an arrow that indicate so as to face the surface of the upper plate 8 upward. The character or the symbol may be printed or formed by die cutting. The packaging box as illustrated in FIG. 12B includes a handgrip 33*a* that guides the worker to place the packaging box with the surface of the upper plate 8 facing up to put the hand on the handgrip 33*a*. The packaging box may have either one or both of structures illustrated in FIGS. 12A and 12B. These structures guide the worker to place the packaging box with the maximum surface facing up and open the upper plate having the maximum area.

The above-described packaging boxes of the first to fourth embodiments and the variations each have the holding mechanism to hold the folded inward contact flap to be in contact with one of the second pair of side plates. As a result, the packaging boxes of the first to fourth embodiments and the variations can prevent the occurrence of the disadvantage caused by the end of the folded inward contact flap positioned near the center of the packaging box. In other words, the packaging boxes of the first to fourth embodiments and the variations solve the disadvantage that the packaged object inserted into the opening of the packaging box hits the end of the folded inward contact flap positioned near the center of the packaging box and is damaged. The disadvantage caused by the end of the folded inward contact flap positioned near the center of the packaging box is not limited to this. The packaging box including the folded inward contact flap according to the present disclosure has various kinds of effects such as improving strength of the packaging box that is performed by the folded inward contact flap in contact with the side plate. In the above-described embodiments and variations, the worker is not limited to a human being and may be a robot. The above-described embodiments are illustrative and do not limit this disclosure.

Thus, numerous additional modifications and variations are possible in light of the above teachings. For example, elements at least one of features of different illustrative and exemplary embodiments herein may be combined with each other at least one of substituted for each other within the scope of this disclosure and appended claims. The number, position, and shape of the components described above are not limited to those embodiments described above. Desirable number, position, and shape can be determined to perform the present disclosure.

What is claimed is:

1. A packaging box comprising:

a first pair of side plates facing each other;

a second pair of side plates facing each other;

an upper plate to close an upper opening of the packaging box;

a bottom plate to close a lower opening of the packaging box;

a folded inward contact flap connected to a lateral side of one of the first pair of side plates and folded at the lateral side to be in contact with one of the second pair of side plates; and a holding mechanism holding contact between the folded inward contact flap and the one of the second pair of side plates, wherein the upper plate is configured to open and close the upper opening, and wherein the other one of the first pair of side plates covers an end of the folded inward contact flap and is configured as a lateral lid flap to open and close a lateral opening of the packaging box.

2. The packaging box according to claim 1, wherein the end of the folded inward contact flap is at a position at which the end of the folded inward contact flap is visible through the lateral opening.

3. The packaging box according to claim 1, wherein the lateral lid flap includes a folded portion in contact with one of the second pair of side plates in the packaging box with the lateral opening closed, and wherein the end of the folded inward contact flap and an end of the folded portion have tapered shapes facing each other.

4. The packaging box according to claim 1, wherein an edge face of the end of the folded inward contact flap is in the lateral opening and in contact with an inner surface of the lateral lid flap.

5. The packaging box according to claim 1, wherein the holding mechanism includes a projection disposed on at least one of an upper side of the folded inward contact flap or a lower side of the folded inward contact flap and a cutout hole into which the projection is inserted, the cutout hole disposed in at least one of the upper plate or the bottom plate.

6. The packaging box according to claim 1, further comprising a folded flap connected to an upper side of the other one of the second pair of side plates and configured to be folded at the upper side of the other one of the second pair of side plates to be in contact with the other one of the second pair of side plates.

7. The packaging box according to claim 6, further comprising a tongue portion connected to the upper plate and inserted into a hole between the other one of the second pair of side plates and the folded flap.

8. The packaging box according to claim 6, further comprising an outer lid flap being connected to the one of the second pair of side plates and covering the other one of the first pair of side plates, the outer lid flap including a tongue portion inserted into a space between the other one of the second pair of side plates and the folded flap.

9. A sheet material to form a packaging box, comprising:

a first pair of side plates facing each other;

a second pair of side plates facing each other;

an upper plate configured to close an upper opening of the packaging box;

a bottom plate to close a lower opening of the packaging box;

a folded inward contact flap connected to a lateral side of one of the first pair of side plates and configured to be folded at the lateral side to be in contact with one of the second pair of side plates; and a holding mechanism configured to hold contact between the one of the second pair of side plates and the folded inward contact flap after the folded inward contact flap is folded, wherein the other one of the first pair of side plates covers an end of the folded inward contact flap and is configured as a lateral lid flap to open and close a lateral opening of the packaging box.

* * * * *